US009688041B2

(12) United States Patent
Scheidl et al.

(10) Patent No.: US 9,688,041 B2
(45) Date of Patent: Jun. 27, 2017

(54) DRIVE DEVICE FOR A BENDING PRESS

(75) Inventors: Rudolf Scheidl, Erlauf (AT); Karl Ladner, Linz (AT); Peter Ladner, Leonding (AT)

(73) Assignee: TRUMPF Maschinen Austria GmbH & Co. KG., Pasching (AT)

( * ) Notice: Subject to any disclaimer, the term of this patent is extended or adjusted under 35 U.S.C. 154(b) by 1167 days.

(21) Appl. No.: 13/516,345

(22) PCT Filed: Dec. 15, 2010

(86) PCT No.: PCT/AT2010/000482

§ 371 (c)(1),
(2), (4) Date: Jul. 11, 2012

(87) PCT Pub. No.: WO2011/079333

PCT Pub. Date: Jul. 7, 2011

(65) Prior Publication Data

US 2012/0272708 A1 Nov. 1, 2012

(30) Foreign Application Priority Data

Dec. 17, 2009 (AT) ..... A 2004/2009

(51) Int. Cl.
*B30B 15/16* (2006.01)

(52) U.S. Cl.
CPC ..... *B30B 15/161* (2013.01); *B30B 15/16* (2013.01)

(58) Field of Classification Search
CPC ..... B30B 1/32; B30B 15/161; B30B 15/16; B30B 15/285; B30B 15/28; B30B 15/18;
(Continued)

(56) References Cited

U.S. PATENT DOCUMENTS 1,262,130 A * 4/1918 Steven ..... F15B 11/02 91/183
2,192,778 A * 3/1940 Stacy ..... B21D 24/14 91/189 R
(Continued)

FOREIGN PATENT DOCUMENTS

DE 11 20 842 12/1961
FR 1 023 703 3/1953
(Continued)

OTHER PUBLICATIONS

International Search Report of PCT/AT2010/000482, Aug. 23, 2011.

*Primary Examiner* — Moshe Wilensky
*Assistant Examiner* — Pradeep C Battula
(74) *Attorney, Agent, or Firm* — Collard & Roe, P.C.

(57) ABSTRACT

A drive device for a bending press, in particular a press brake, with a press frame includes a stationary press beam and has a press beam which can be displaced relative to the press beam by a beam adjusting device formed by a closed hydraulic system including a hydraulic pump with a controllable drive motor, at least one control valve and at least one hydraulic linear actuator. The linear actuator includes a first piston arrangement with a first piston dividing a cylinder chamber into a first pressure chamber and a second pressure chamber and, in another cylinder chamber, a second piston arrangement with another piston and at least one other pressure chamber. The first piston arrangement and the second piston arrangement are coupled with one another.

22 Claims, 8 Drawing Sheets

(58) Field of Classification Search
CPC ..... B30B 15/183; B30B 15/186; B30B 1/323; B30B 1/20; B30B 1/22; B30B 1/24; B30B 1/245; B21D 24/14; B21D 5/00; B21D 5/02; F15B 11/022; F15B 11/036; F15B 11/0365; F15B 15/1409; F15B 15/1404; B29C 53/80; B29C 53/8041; B21J 9/14; B21J 9/12
See application file for complete search history.

(56) References Cited

U.S. PATENT DOCUMENTS

| | | | | | |
|---|---|---|---|---|---|
| 2,386,568 | A | * | 10/1945 | Page | F15B 15/1404 100/209 |
| 3,143,924 | A | * | 8/1964 | Pearson | B21D 5/02 91/171 |
| 3,818,801 | A | | 6/1974 | Kime | |
| 3,939,686 | A | * | 2/1976 | Walters | B21D 5/029 100/291 |
| 4,152,913 | A | * | 5/1979 | Zerhoch | B21D 1/02 72/165 |
| 4,630,442 | A | | 12/1986 | Massaro et al. | |
| 5,865,088 | A | * | 2/1999 | Nakabayashi | B30B 1/32 60/560 |
| 5,957,046 | A | | 9/1999 | Nakabayashi et al. | |
| 5,957,049 | A | | 9/1999 | Ammeter et al. | |
| 6,003,429 | A | * | 12/1999 | Nakabayashi | F15B 11/036 60/560 |
| 6,240,758 | B1 | | 6/2001 | Nagakura | |
| 8,555,635 | B2 | * | 10/2013 | Webster | F15B 11/22 91/189 A |
| 2010/0212521 | A1 | | 8/2010 | Resch et al. | |

FOREIGN PATENT DOCUMENTS

| | | |
|---|---|---|
| FR | 2 318 730 | 2/1977 |
| FR | 2 589 390 | 5/1987 |
| GB | 1 436 531 | 5/1976 |
| JP | 56-018200 | 2/1981 |
| JP | 57-181499 | 11/1982 |
| JP | 2002-147404 | 5/2002 |
| WO | WO 99/54123 | 10/1999 |
| WO | WO 2009/033199 | 3/2009 |

* cited by examiner 1
5
6
7
43
33
22
9
39
23
52
51
3
28
32
41
26
11
40
10
8
12
35
53
48
36
27
38
44
37
42
25
M
34
29
24
31
15
46
47
54
50
30
4
45
18
16
14
20
18
16
2
13

DRIVE DEVICE FOR A BENDING PRESS

CROSS REFERENCE TO RELATED APPLICATIONS

This application is the National Stage of PCT/AT2010/000482 filed on Dec. 15, 2010, which claims priority under 35 U.S.C. §119 of Austrian Application No. A 2004/2009 filed on Dec. 17, 2009, the disclosure of which is incorporated by reference. The international application under PCT article 21(2) was not published in English.

The invention relates to a drive device.

From document WO 2009/033199 A1, a drive device for a bending press, in particular a press brake, is known, where a press beam can be displaced relative to a stationary press beam by means of a closed, hydraulic drive system essentially comprising a hydraulic pump with a controllable drive motor, switching and control means, pressure lines and at least one linear actuator to which pressurizing medium can be applied. The linear actuator is provided in the form of a double acting hydraulic cylinder, and a cylinder housing is secured to the press frame or to the displaceable press beam and an actuator means of a piston arrangement is connected to the displaceable press beam or to the press frame or to the stationary press beam. The hydraulic pump of the drive system is driven by the drive motor in a controllable direction of rotation and at a controllable speed.

From another document, JP 2002 147404 A, a hydraulic drive system for a hydraulic cylinder with several pressure chambers forming a closed hydraulic system is known and has a reversibly driven hydraulic pump disposed in a ring line. A pressure storage is provided in a ring line in order to activate the hydraulic cylinder with pressurizing medium and compensate a differential volume of the pressurizing medium due to the different volumes of the pressure chambers of the hydraulic cylinder, and establishes a flow connection with at least one pipe run of the ring line via a control valve and a connecting line.

The objective of the invention is to propose a drive device with a hydraulic system for a displaceable press beam of a bending press, by means of which a high overall degree of efficiency of the drive device is obtained in all operating modes with low energy consumption and low emissions.

This objective is achieved on the basis of the features described herein. Due to the design of a beam adjusting device comprising at least one linear actuator with at least three pressure chambers which can be activated via the hydraulic system in accordance with special requirements prevailing during the respective displacement part-cycle to be performed as part of an overall displacement cycle, the surprising advantages are achieved that the requisite pressure and volume of pressurizing medium can be finely adjusted, thereby optimizing and adapting the performance of the pump needed for this purpose as well as the displacement speed.

Also of advantage is an embodiment in which, cylinder chambers form four separate, pressure-tight pressure chambers due to the pistons of the piston arrangements, because additional control sequences for optimizing displacement operations of the displaceable press beam and a total cycle time are obtained as a result.

As a result of another possible embodiment in which the pistons of the piston arrangements are rigidly coupled with one another via a piston rod and are connected to the displaceable press beam in a driving relationship by an actuator formed by another piston rod, a very compact unit is obtained for the linear actuator, which can therefore be positioned on the press frame of the press brake whilst requiring little space.

Also of advantage is an embodiment in which piston arrangements are connected to the displaceable press beam in a driving relationship respectively by an actuator formed by the pisto rods, whereby, depending on the press type, different designs may be used for the displacement drive of the press beam.

Due to another advantageous embodiment in which the cylinder chambers are disposed concentrically with respect to a mid-axis in an actuator housing provided in the form of a booster cylinder, an actuator housing can be manufactured with several pressure chambers.

Depending on the size of the press brake, another advantageous design has cylinder chambers disposed with mid-axes extending parallel with one another in an accuator housing provided in the form of a tandem cylinder and offers a solution which makes it easier to extend the press brake.

Other advantageous embodiments include piston working surfaces of the piston arrangements co-operating with the pressure chambers and having different surface dimensions, wherein a first piston working surface approximately corresponds to a surface total of a second piston working surface plus a third piston working surface, such that, from the point of view of the hydraulic working surfaces, a behavior akin to a synchronous cylinder can be obtained with surfaces adapted to the corresponding working direction and this makes is possible to adapt to the different speed ranges for the individual displacement cycles, which means that the hydraulic system as a whole can be operated with a small volume of pressurizing medium and the control valves, control lines and hydraulic pump with the drive can be minimized in terms of throughput and performance, whilst also keeping noise and temperature emissions low.

Another embodiment, in which a surface total of respectively two piston working surfaces corresponds to a surface total of respectively two other piston working surfaces, is advantageous because the flow of advantageous because the flow of pressurizing medium for the different displacement sequences can be optimized in terms of the displacement speed and force required.

Other advantageous embodiments include the actuator housing being of a one-piece design or of a multi-part design and enable advantageous variants of designs of linear actuators to be obtained, which are adapted to the respective press type.

Based on other advantageous embodiments, in which the actuator housing is rigidly connected to the press frame and the actuator or the piston rods are connected to the displaceable press beam in a driving relationship via bearing arrangements, a simple construction for the press brake is obtained.

Other advantageous embodiments include the hydraulic pump being provided in the form of a hydraulic four-quadrant machine and a drive motor of the hydraulic pump being provided in the form of an electric motor, the rotation speed and direction of rotation of which can be varied, for example, and ensure a small design of the hydraulic pump and its drive motor and a configuration whereby the main pressure is applied during a work operation of forming a workpiece, the pump acting from one side and, adapted to this, the hydraulic pump can be optimized so as to make significantly lower pressure levels necessary for the other displacement cycles, thereby ensuring low costs for the drive device and a high energy efficiency.

Another advantageous embodiment is also possible in which the hydraulic system has a control valve in the form of an emergency stop retaining valve and has at least two control valves for activating the pressure chambers, whereby the hydraulic system requires less work to assemble and can be prefabricated as a compact unit satisfying safety requirements so that a drive module is obtained which can be tested prior to mounting on the press to ensure that it meets the requisite quality standards. Also as a result of this design of the hydraulic system, with regard to the operating status and control function for the respective displacement operation, an optimization can be obtained in terms of the volume of pressurizing medium to be controlled, thereby offering the possibility of sequence crossovers in the control program by activating the valves accordingly.

Also of advantage is an embodiment offering another variant of the hydraulic system in which the control valve incorporates the emergency stop function and is disposed in a connecting line of the pressure chamber of the piston arrangement to the ring line.

As a result of other advantageous embodiments in which a flow connection is established between a storage and pump lines via connecting lines and releasable check valves are disposed in the connecting lines, a drive device requiring a low volume of pressurizing medium is obtained due to a closed hydraulic system comprising a pressure storage integrated in the circuit serving as an intermediate buffer which can be activated as and when necessary.

Also of advantage, however, are other embodiments, in which the check valves are of a hydraulically releasable design, the check valves are configured so as to be electrically releasable, and the control valves are provided in the form of switchable, spnng-resettable multi-way valves, because they make it possible to use control elements suitable for operation over long periods of time without disruptions and faults.

Other advantageous embodiments include the piston arrangements that form the four pressure chambers having continuous piston rods which are coupled with one another, the piston rods respectively having two rod regions of different diameters from one another and separated by the pistons, the piston arrangements with the rod regions of different diameters being disposed in a complementary layout in the cylinder chambers, the internal diameters of the cylinder chambers being of identical dimensions. These embodiments enable piston working surfaces and hence the hydraulic action to be adapted in different ways.

Finally, an embodiment in which the internal diameters of the cylinder chambers are of different dimensions is of advantage because another variant of the design of the linear actuator is obtained.

To provide a clearer understanding, the invention will be described in more detail below on the basis of examples of embodiments illustrated in the appended drawings Of these:

Figure 1:
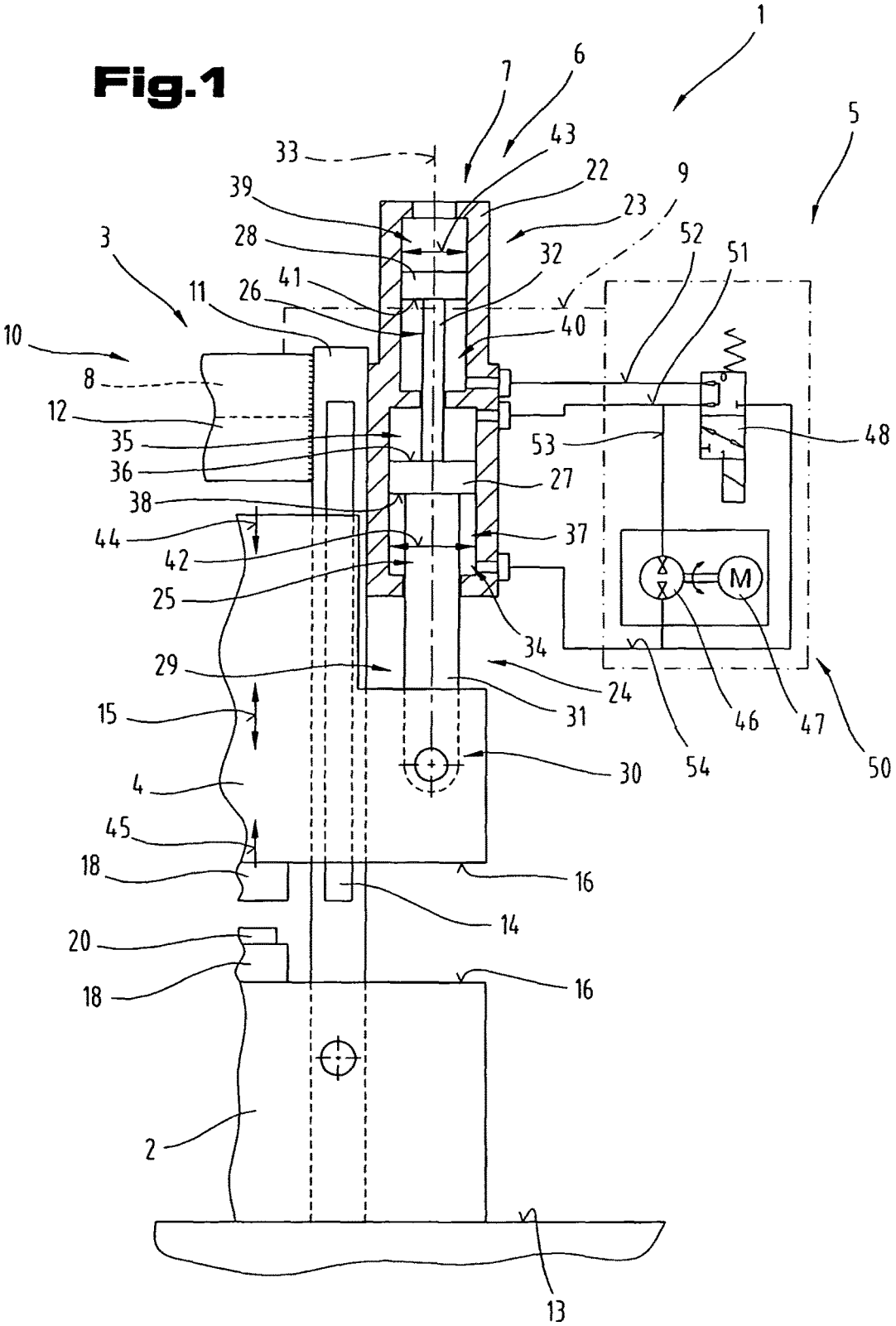
FIG. 1 illustrates a drive device proposed by the invention on a press brake, in this example constituting a drive shaft for a displaceable press beam, viewed in partial section.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

FIG. 1 is a simplified diagram illustrating a drive device 1 for a press beam 4 which can be displaced relative to a stationary press beam 2 of a bending press 3.

To simplify the explanation, the main embodiment illustrated as an example is a drive shaft for the displaceable press beam 4 of the bending press 3, and it should be pointed out that different designs with from one to several drive shafts may be used, depending on the size and forming capacity. The drive device 1 further comprises a hydraulic system 5, which, in the case of the embodiment described and illustrated, is a simplified basic version of a beam adjusting device 6 for a hydraulic linear actuator 7. If several linear actuators 7 are operated in parallel as a means of displacing the press beam 4, this must be taken into account as part of the technical design of the hydraulic system 5 in terms of its power.

In the situation where there are several linear actuators 7, they may be operated jointly by means of one hydraulic system 5 or alternatively a hydraulic system 5 may be provided for each of the linear actuators 7.

The hydraulic system(e) is (are) connected to a control and regulating system 8 of the bending press 3 via at least one control line 9 and hence forms (form) part of an actuating, regulating and control sequence.

As shown in the embodiment illustrated as an example, a press frame 10 comprises the stationary press beam 2 secured to side panels 11 and a cross member 12 accommodating various hydraulic, mechanical and electrical devices and sits as a compact unit on a floor surface 13.

As illustrated by way of example, the displaceable press beam 4 is mounted so that it can be displaced—as indicated by double arrow 15—in linear guide arrangements 14 on the press frame 10 or on the side panels 11 in a direction perpendicular to the floor surface 13.

Disposed on oppositely lying support surfaces 16 of the press beam 2, 4 are a number of interchangeable bending tools 18 in separate tool holders for forming a workpiece 20.

In particular, the bending tools 18 are one or more bending punches and one or more bending dies which are combined respectively to form a die set suitable for a specific forming operation as necessary.

In the embodiment illustrated as an example, the linear actuator 7 of the beam adjusting device 6 is secured to the press frame 10 by means of an actuator housing 22, e.g. on a side face of the side panel 11, and in the embodiment illustrated as an example is a booster cylinder 23. A common actuator means 24, e.g. a first piston arrangement 25 and a second piston arrangement 26 comprising a first piston 27 and a second piston 28, can be connected to the displaceable press beam in a driving relationship, in particular the actuator means 24 is connected to the displaceable press beam 4 by means of a spherical bearing arrangement 30 at an end region 29 projecting out of the actuator housing 22.

The actuator means 24 in this embodiment comprise a first piston rod 31 with the first piston 27 and a second piston rod 32 with the second piston 28 and the piston rods 31, 32 and hence the piston arrangements 25, 26 are rigidly connected to one another and the pistons 27, 28 are disposed concentrically with one another by reference to a mid-axis 33.

A first cylinder chamber 34 of the linear actuator 7 is sub-divided by the piston 27 of the first piston arrangement 25 into a first pressure chamber 35 with a first piston working surface 36 and a second pressure chamber 37 with a second piston working surface 38 in a pressure-tight arrangement.

Another cylinder chamber 39 together with the second piston arrangement 26 with the piston 28 forms a cylinder acting at one end with a pressure chamber 40 and a third piston working surface 41.

Depending on the dimensioning of the piston rods 31, 32 and internal diameters 42, 43 of the cylinder chambers 34, 39 of the piston arrangements 25, 26, piston working surface 36, 38, 41 adapted to one another by the hydraulic action are obtained as a means of displacing and applying force to the displaceable press beam 4 to meet the different requirements of the respective part-cycle of an overall cycle of the process of displacing the press beam 4—as will be explained in more detail below.

The dimensioning of the piston working surfaces 36, 38, 41 is such that the first piston working surface 36 corresponds approximately to the sum of the second piston working surface 38 and third piston working surface 41, and the hydraulic working direction—indicated by arrow 44—in which the first piston arrangement 25 displaces the press beam 4 by means of the first piston working surface 36 is directed in the direction towards the stationary press beam 2.

Based on the embodiment of the linear actuator 7 illustrated with the piston arrangements 25, 26, the second piston working surface 38 of the first piston arrangement 25 and the piston working surface 41 of the second piston arrangement 26 are decisive in terms of an opposite hydraulic working direction—indicated by arrow 45.

The linear actuator 7 provided in the form of a booster cylinder 23 with the piston arrangements 25, 26 connected in a mechanically rigid manner therefore has pressure chambers 35, 37, 40 with associated hydraulically active piston working surfaces 36, 38, 41, the surface totals of which, taking account of their hydraulic working direction, approximately cancel each other out. Opting for the embodiment based on a booster cylinder 23 results in a very compact linear actuator 7 which requires little space and is secured to the press frame 10 by means of the actuator housing 22.

The actuator housing 22 may be based on a one-piece design or may be a design comprising several parts with centered cylinder chambers 34, 39 disposed concentrically with one another. The rigid coupling of the second piston arrangement 26 with the first piston arrangement 25 is achieved on the basis of a mechanical connection of the piston rod 32 of the second piston arrangement 26 to the piston 27 of the first piston arrangement 25.

The hydraulic system 5 illustrated in FIG. 1 provided as a means of operating the beam adjusting device 6 is a simplified version of operating the bending press 3 reduced to the basic functions, its components being a hydraulic pump 46 with a drive motor 47 and a control valve 48 and the requisite lines.

The hydraulic pump 46 is preferably a hydraulic four-quadrant machine, and the main pressurization in terms of the pressure applied predominantly takes place in one working stroke—indicated by arrow 44—i.e. directly when a bend is made to the workpiece 20 between the bending tools 18. It is therefore also possible to design the hydraulic pump 46 as a pump acting at one end because it is able to operate the other quadrants with significantly lower pressures.

The drive motor 47 is an electric motor, for example, the speed of which can be regulated and the direction of rotation of which can be regulated, and operates all four quadrants in order to move the press beam 4 down and up—as indicated by arrows 44, 45.

The control valve 48 is used to switch to fast-traverse operation, and in the case of the "0" switch position illustrated, this is the fast-traverse position and the other switch position "1"—which is electrically activated by the control and regulating system 8—is the operation position. The control valve 48 is an electrically switchable and spring-biased 2-way actuator valve.

The basic function of a standard bending process for bending the workpiece 20 is broken down into part-cycles, starting from an end position of the displaceable press beam 4 at a distance away from the stationary press beam 2 with a fast-traverse movement in the direction towards the stationary press beam 2 followed by a work operation movement at a significantly reduced speed of the press beam 4 until a predefined reverse position is reached, corresponding to a depth of the bending tools 18 needed to produce a required degree of bending.

Once the reverse position has been reached, a release stroke follows at the reduced speed and then a quick return stroke into the end position at a distance away from the stationary press beam 2.

The fast-traverse switching operation is run for a high acceleration and speed and the work switching operation for a lower acceleration and speed, and the work switching operation represents a minimal partial distance in the reverse part of the stroke compared with a total displacement distance.

The basic hydraulic function broken down into the described cycles of a typical bending process will be explained below with reference to the simplified basic design of the hydraulic system 5 illustrated in FIG. 1.

During the part-cycle—of the fast-traverse movement of the displaceable press beam in the direction of the stationary press beam 2—the control valve 48 is in the illustrated "0" switch position in which a flow connection is established with the pressure chambers 35, 40 by means of the co-operating first piston working surface 36 and third piston working surface 41 via lines 51, 52. A flow connection is also established between lines 51, 52 via lines 53, 54 and the pressure chamber 37 of the first piston arrangement 25 and the co-operating piston working surface 38 with the hydraulic pump 46 connected in between.

The piston working surfaces 36, 41 are designed so that the resultant hydraulic working surface in this switch mode approximately corresponds to piston working surface 38. Accordingly, from the point of view of the hydraulic working surfaces, the system imitates the behavior of a synchronous cylinder with an annular surface corresponding to piston working surface 38. This enables an active acceleration in the fast-traverse part of the cycle.

Due to the fact that the piston working surface 38 is selected so that it is relatively small compared with piston working surface 36, high fast-traverse speeds can be achieved for a low flow volume of pressurizing medium through the hydraulic pump 46. The ratio of the piston working surfaces 36, 38 corresponds to the speed ratio between the fast-traverse movement part of the cycle and the working movement at the same pump rotation speed.

The part-cycle following the fast-traverse movement in the direction of the stationary press beam 2—work operation movement—takes place in switch position "1" of the control valve 48. In this switch position, pressurizing medium is drawn from the pressure chambers 37, 40 via the hydraulic pump 46 and lines 52, 54 by means of the co-operating piston working surfaces 38, 41 and fed via lines 53, 51 to the first pressure chamber 35 by means of the co-operating first piston working surface 36, as a result of which the behavior of a synchronous cylinder is imitated from the point of view of the hydraulic piston working surfaces 36, 38, 41.

Following the part-cycle work operation movement in the direction of the stationary press beam 2 is the part-cycle relief movement in the direction opposite the stationary press beam 2, by means of which a controlled decompression of the pressurizing medium takes place along with a release of the press beams 2, 4 and press frame 10 and during which a rebounding of the forming action on the workpiece also takes place.

In terms of the hydraulics, this takes place when the control valve 48 is in switch position "1" as already described above in connection with the work operation movement as the direction of rotation is reversed, and the pressurizing medium is therefore fed through the hydraulic pump 46 in the opposite direction.

Based on a preferred design for actuating the linear actuator 7 in order to displace the press beam 4, before making the switch for the other part-cycle for a fast-traverse movement in the direction opposite the stationary press beam, an angular measurement of the forming takes place after the decompression movement and a final bending operation is run if necessary in order to correct the bending angle.

The subsequent fast-traverse movement constituting the terminating part-cycle takes place in the same way as the fast-traverse movement in the direction of the stationary press beam 2 in switch position "0" of the control valve 48. Accordingly, a flow connection is established between the first pressure chamber 35 and the first piston working surface 36 and between the third pressure chamber 40 and the third piston working surface 41, and the pressurizing medium is conveyed by the hydraulic pump 46 into the second pressure chamber 37 with the relatively small piston working surface 38 co-operating with it, causing a high acceleration and speed during the return movement of the displaceable press beam 4 into the end position at a distance away from the stationary press beam 2.

Due to the special linear actuator 7 and corresponding design of the surface ratios of the piston working surfaces 36, 38, 41, a high fast-traverse speed is achieved when the switch to fast-traverse operation is made but also a strong application of force when the switch is made to the work operation with a relatively small hydraulic pump 46 and low energy consumption.

Special mention should be made of the special feature of the at least three hydraulic working surfaces of the linear actuator 7, which cancel each other out din terms of their hydraulic pressurizing effect. Naturally, it would also be possible to achieve similar behavior with more than three hydraulic working surfaces, for example using several cylinders, in which case it is vital that the working surfaces virtually cancel each other out by reference to the direction. In order to make it possible to switch between the behavior of a synchronous cylinder with a small hydraulic working surface and that of a synchronous cylinder with a large hydraulic total working surface, however, at least three working surfaces are necessary.

The switch between fast traverse and work operation takes place by means of one or more valves. Since, in all operating modes, the behavior of synchronous cylinders is imitated, no oil is drawn off from or fed to the linear actuator 7. The pressurizing medium is merely conveyed between the individual pressure chambers 35, 37, 40, as a result of which a hydraulic system 5 can be obtained which is able to operate without a tank or oil reservoir, thereby ensuring a completely closed hydraulic system. The total oil volume can be kept very low as a result.

Figure 2:
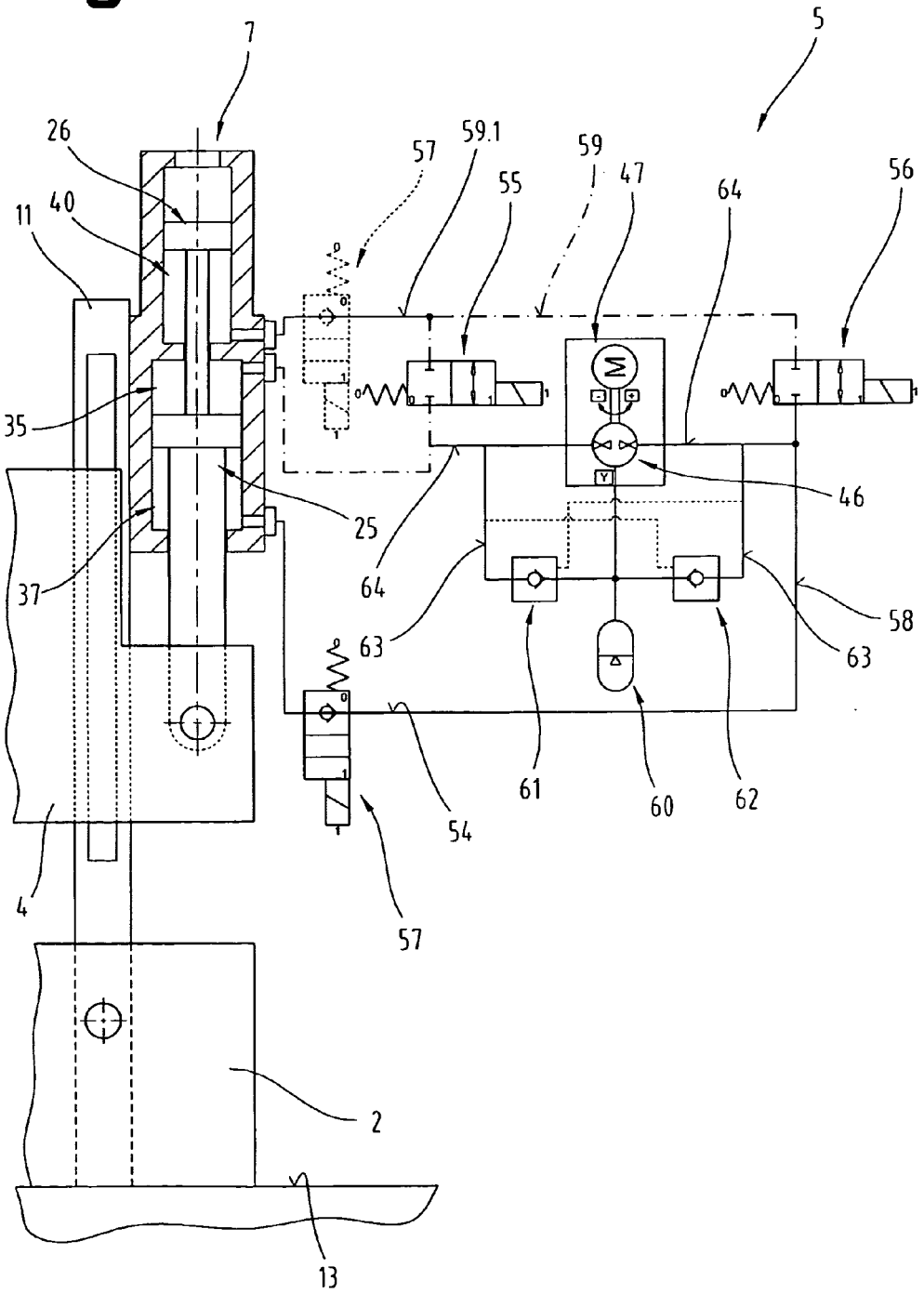
FIG. 2 shows another embodiment of the drive device proposed by the invention with an advantageous embodiment of the drive shaft, viewed in partial section.

FIG. 2 illustrates another embodiment of the drive device 1, which may be construed as an independent embodiment in its own right, with the hydraulic system 5 for pressurizing the linear actuator 7 in order to drive the displaceable press beam 4 of the bending press 1. As with the example described above, it is illustrated on the basis of only one drive shaft by way of example, and it should be pointed out that it would also be possible to opt for a design of hydraulic components operating in parallel to drive several linear actuators 7 and this is a totally standard way of achieving a correspondingly higher bending power.

The same reference numbers and components names are used in the description below to denote parts that are the same as those already described in connection with FIG. 1 above. To avoid unnecessary repetition, reference may be made to the more detailed description of FIG. 1 given above.

Based on the embodiment corresponding to FIG. 2, a first control valve 55 and a second control valve 56 are provided as a means of switching the linear actuator 7 comprising the first piston arrangement 25 and second piston arrangement 26, which in turn form the first pressure chamber 35, second pressure chamber 37 and third pressure chamber 40. The advantage of this is that it offers a valve optimization because, in the case of the operating mode in fast traverse high and during the working operation lower flow volumes need to be fed to the linear actuator 7 and pressure chambers 35, 37, 40. By dividing the function between the control valves 55, 56, therefore, the respective control valve can be adapted to the flow volumes so that it is optimum in terms of size. This also offers the possibility of achieving different crossovers in the control sequence if the control valves 55, 56 are activated accordingly.

A control valve 57 serving as a safety valve for an emergency stop function is provided in line 54, which is connected in a first ring line 58 of the pressure chamber 37 via the hydraulic pump 46 and control valve 56 to pressure chamber 35 of the first piston arrangement 25, or via a second ring line 59 and control valve 56 and a connecting line 59.1—indicated by broken lines—to pressure chamber 40 of the second piston arrangement 26.

In the illustrated switch position "0" of the control valve 57, the flow connection described above is prevented and a reliable holding or emergency stop function for preventing the press beam 7 from being moved in the direction of stationary press beam 4 is guaranteed.

However, FIG. 2 illustrates another variant of how the control valve 57 for the emergency stop function is disposed—indicated by broken lines—whereby it is also possible to provide it in a connecting line 59.1 between pressure chamber 40 of the second piston arrangement 26 and the ring line 59.

In this variant of the embodiment, the hydraulic system 5 is extended in that it also has a storage 60 and two check valves 61, 62 which can be released by applying pressurizing medium, and the storage 60 is connected to pump lines 64 via lines 63 in which the check valves 61, 62 are disposed.

The storage 60 is used to accommodate a small volume of pressurizing medium, which is needed and accommodated in addition on the one hand in the closed system as the pressure is being built up during pressing and to compensate for temperature or to compensate for small leakages. Accordingly, if the system is sealed accordingly, it can be assumed that the storage volume can be kept at an extremely low level. The pressure in the hydraulic system and hence in the storage 60 is low and does not play any significant role in the overall function but helps to prevent cavitation of the hydraulic pump 46 during high accelerations.

Apart from fulfilling this supporting function, the storage 60 is an air-tight, pre-pressurized tank from a functional point of view. By means of the releasable check valves 61, 62, pressurizing medium can be fed in and out of the storage 60 through the hydraulic circuits. This is necessary, for example, when building up and reducing pressure in a higher hydraulic capacity. In the event of a change in temperature, the requisite compensating volume is fed in or out via these check valves 61, 62 in the desired operating modes only.

Figure 3:
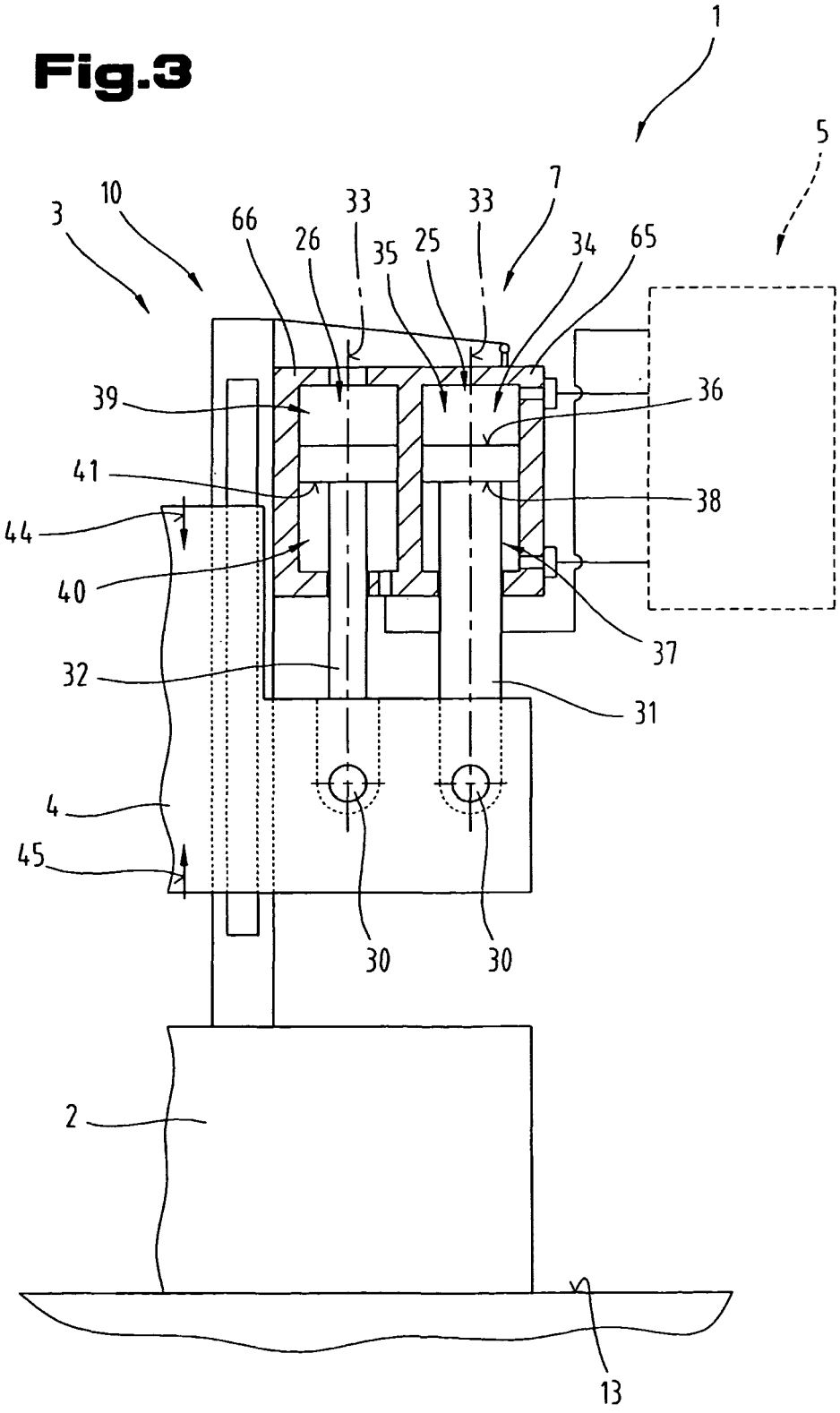
FIG. 3 shows another embodiment of the drive device proposed by the invention with a linear actuator in the form of a tandem cylinder, viewed in partial section.

FIG. 3 illustrates another embodiment of the linear actuator 7 for driving the displaceable press beam 4. The linear actuator 7 in this example of an embodiment is provided in the form of a tandem cylinder 65 and has a cylinder housing 66 which may optionally comprise one or more parts, and, in this example of an embodiment, cylinder chambers 34, 39 disposed parallel with one another have the double acting first piston arrangement 25 with pressure chambers 35, 37 and the single acting second piston arrangement 26 has pressure chamber 40. The piston arrangements 25, 26 therefore form the three pressure chambers 35, 37, 40 with co-operating piston working surfaces 36, 38, 41 which are oriented in the manner already described in connection with FIG. 1 in terms of working direction—indicated by arrows 44, 45.

The one-piece or multi-part cylinder housing 66 is secured to the press frame 10, as illustrated on a simplified basis. The piston rods 31, 32 of the piston arrangements 25, 26 are respectively connected to the displaceable press beam 4 in a driving relationship via the bearing arrangements 30, so that they afford a rigid coupling of the piston arrangements 25, 26. For details of the hydraulic system 5 used for operating purposes, reference may be made to the descriptions given in connection with FIGS. 1 and 2 because the main difference in the case of this drive shaft is merely the fact that the piston arrangements 25, 26 do not have a mechanical connection to the press beam 4, for example one of the piston rods 31, 32, but rather via the rigid coupling of the piston arrangements 25, 26. The essential aspect is that at least three pressure chambers 35, 37, 40 are provided and have the respective co-operating piston working surfaces 36, 38, 41 based on a surface ratio whereby the first piston working surface 36 corresponds approximately to the sum of the second piston working surface 38 and third piston working surface 41 and hence the surface total is approximately neutralized taking account of the hydraulic working direction.

Figure 4:
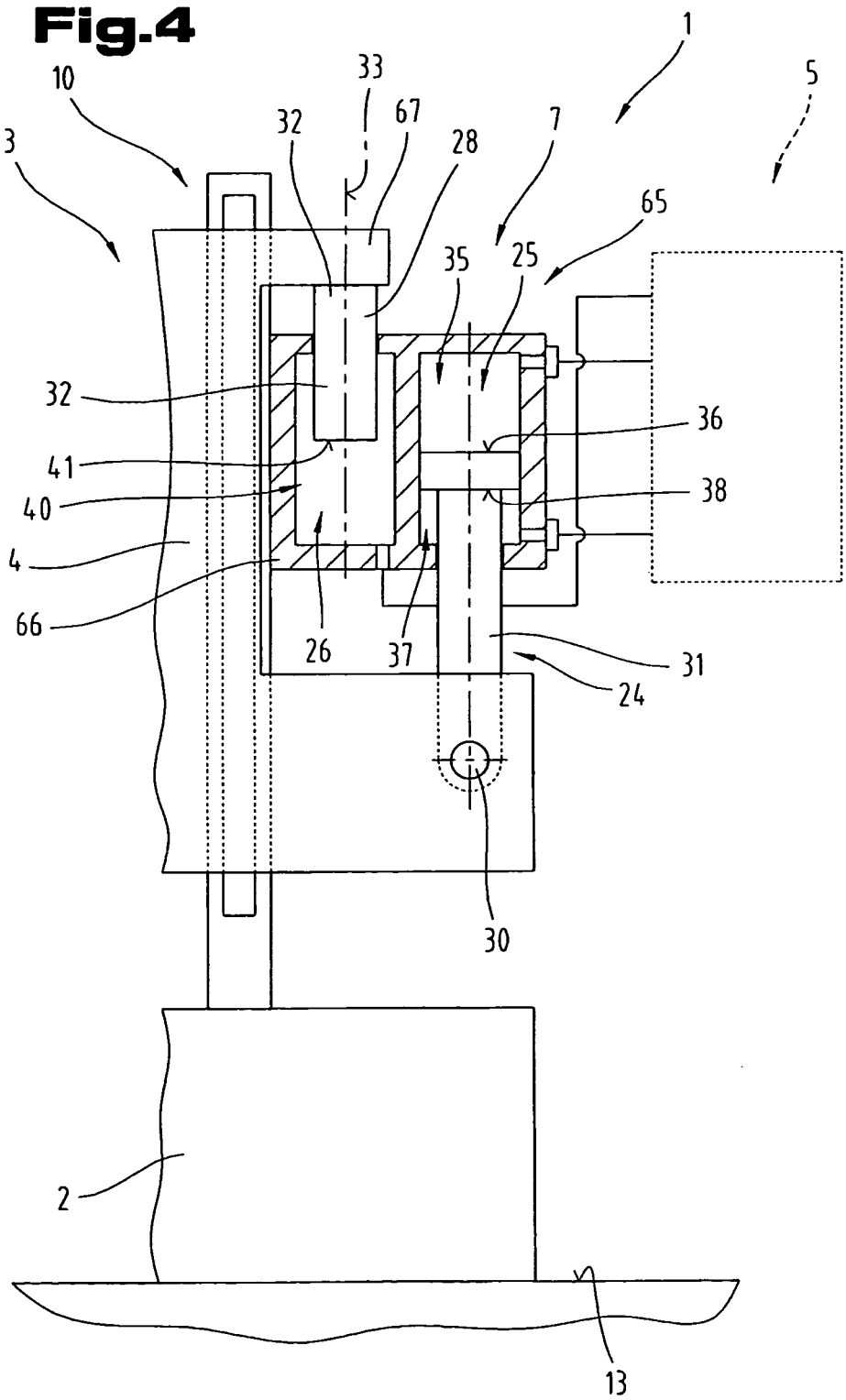
FIG. 4 shows another embodiment of the linear actuator in the form of a tandem cylinder, viewed in partial section.

FIG. 4 illustrates another embodiment of the linear actuator 7 of the drive device 1 for displacing the press beam 4 of the bending press 3.

The linear actuator 7 based on this embodiment also comprises the tandem cylinder 65 with the one-piece or multi-part cylinder housing 66 and has the double acting first piston arrangement 25 and the single acting second piston arrangement 26 disposed parallel with it with the three pressure chambers 35, 37, 40 and the respective co-operating piston working surfaces 36, 38, 41 with the corresponding surface ratio already described above.

The cylinder housing 66 is secured to the press frame 10. In this embodiment, the rigid coupling of the piston arrangements 25, 26 via the displaceable press beam 4 is also provided, and the actuator means 24, respectively piston rod 31, first piston arrangement 25, extends across the cylinder housing 66 in the direction of the stationary press beam 2 and is connected to the displaceable press beam 4 via the bearing arrangement 30.

The piston arrangement 26 which acts from one end extends across the cylinder housing 66 in the direction opposite the piston arrangement 25 by means of the piston rod 32, which acts on a support arm 67 of the displaceable press beam 4 partially extending across the cylinder housing 66 and is connected to the latter in displacement. It is therefore by means of the press beam that the piston arrangements 25, 26 are coupled, so that the latter is rigidly coupled in terms of its freedom of movement.

For details of the hydraulic system 5, reference may likewise be made to the descriptions of possible embodiments given above in connection with FIGS. 1 and 2.

Figure 5:
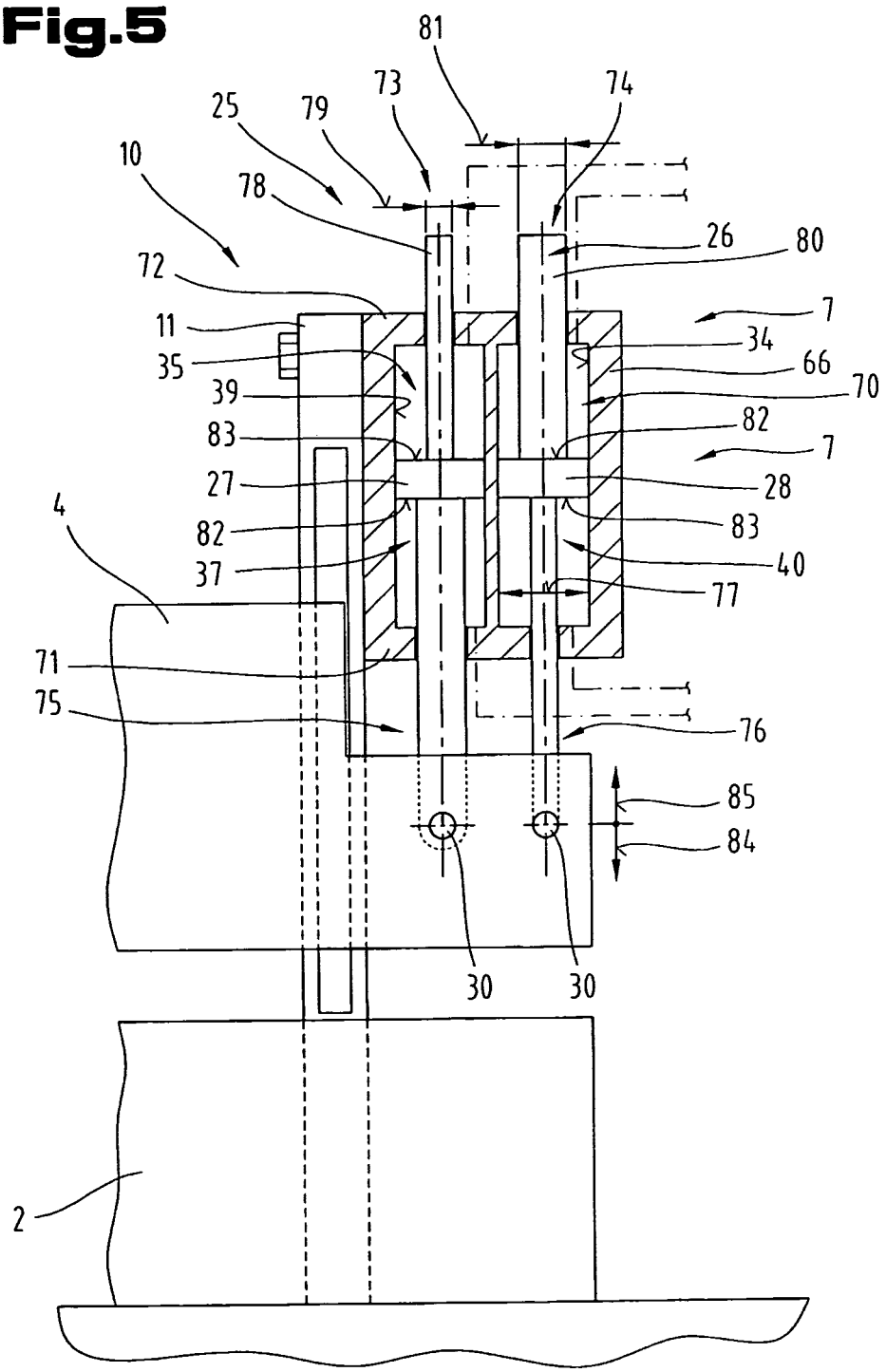
FIG. 5 shows another embodiment of the linear actuator in the form of a tandem cylinder, viewed in partial section.

FIG. 5 illustrates another embodiment of the linear actuator 7 for driving the displaceable press beam 4 based on the example of a drive shaft.

In this example of an embodiment, the linear actuator 7 is provided in the form of a tandem cylinder 65 and has a cylinder housing 66 which may comprise one piece or several parts, with cylinder chambers 34, 39 disposed parallel with one another in this embodiment, with the double acting first piston arrangement 25 with pressure chambers 35, 37 and the second piston arrangement 26, likewise double acting in this embodiment, with pressure chamber 40 and another pressure chamber 70.

The linear actuator 7 is pressurized with pressurizing medium by means of the hydraulic system 5 based on a design adapted to what are now four pressure chambers 35, 37, 40, 70.

The cylinder housing 66 is secured to the press frame 10, in the case of the embodiment illustrated as an example here to the side panel 11. The piston arrangements 25, 26 comprising pistons 27, 28 have continuous piston rods 73, 74 on oppositely lying end walls 71, 72 extending through the actuator housing 66.

End regions 75, 76 of the piston rods 73, 74 facing the press beam 4 are connected to the press beam 4 in a driving relationship respectively by one of the bearing arrangements 30, thereby establishing a non-positive connection of the piston arrangements 25, 26 in displacement.

The cylinder chambers 34, 39 respectively have an identical internal diameter 77. However, each of the piston rods 73, 74 of the piston arrangements 25, 26 has, divided by the pistons 27, 28, a first rod region 78 with a diameter 79 and a rod region 80 with a diameter 81 respectively, which are different in terms of dimensions. As a result of the identical internal diameter 77 of the cylinder chambers 34, 39, there are identical piston working surfaces 82, 83 co-operating in pairs with the pressure chambers 35, 37, 40, 70.

The disposition of the piston arrangements 25, 26 in cylinder chambers 34, 39 extending parallel with one another results in a complementary layout of the piston arrangements 25, 26 where the sum of the piston working surfaces 82, 83 in a hydraulic working direction in which the displaceable press beam 4 is displaced in the direction of the stationary press beam 2—indicated by arrow 84—is equal to the sum of the piston working surfaces 82, 83 for the hydraulic working direction in which the displaceable press beam 4 is displaced in the opposite direction—indicated by arrow 85.

This enables activation of the actuators 7 with the closed hydraulic system 7 by means of the pressurizing medium to be optimized to respective requirements in terms of displacement speed for the displacement operations of the individual work cycles, such as fast traverse stroke downwards, force stroke downwards, release stroke upwards and fast traverse stroke upwards.

As a result of this optimization by which a flow connection to individual pressure chambers 35, 37, 39, 70 is established for predefined displacement operations, the total volume of pressurizing medium can be kept low on the one hand and the volume to be conveyed through the pump in the hydraulic system is also reduced, the advantage of which is a smaller dimensioning of the valves, hydraulic pump with drive as well as lines.

It should also be pointed out that for every drive shaft of the bending press 2, in order to optimize the motion sequences, it would also be perfectly possible to use several linear actuators 7 within the scope of the invention in order to satisfy the different requirements of the part-cycle of an overall displacement cycle, e.g. displacement speed, application of force, and the number of pressure chambers 35, 37, 40 pressurized with the pressurizing medium of a hydraulic system 5 may also be more than three.

Figure 6:
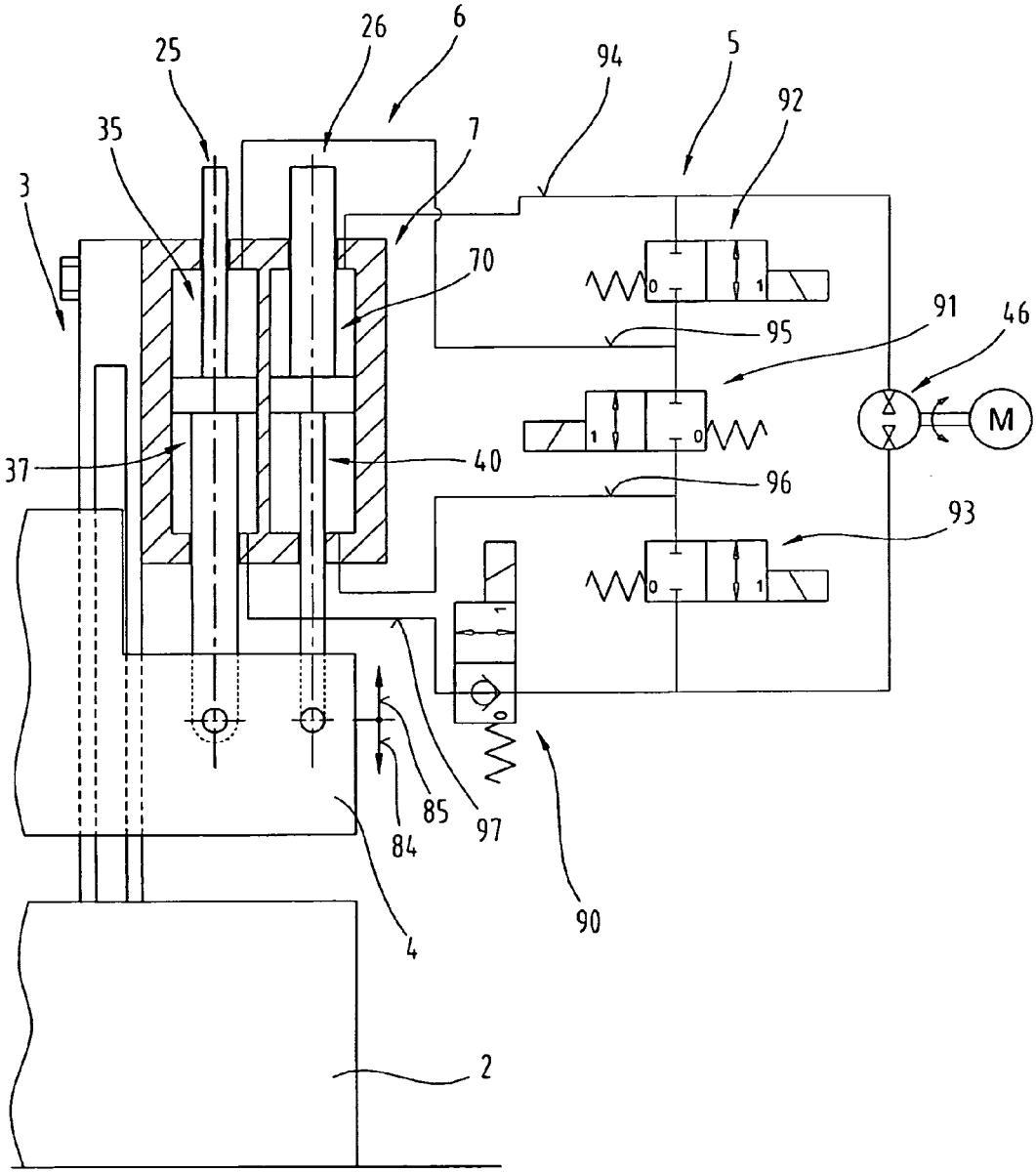
FIG. 6 shows another embodiment of the drive device with a tandem cylinder and a hydraulic system in a first switch mode.
Figure 7:
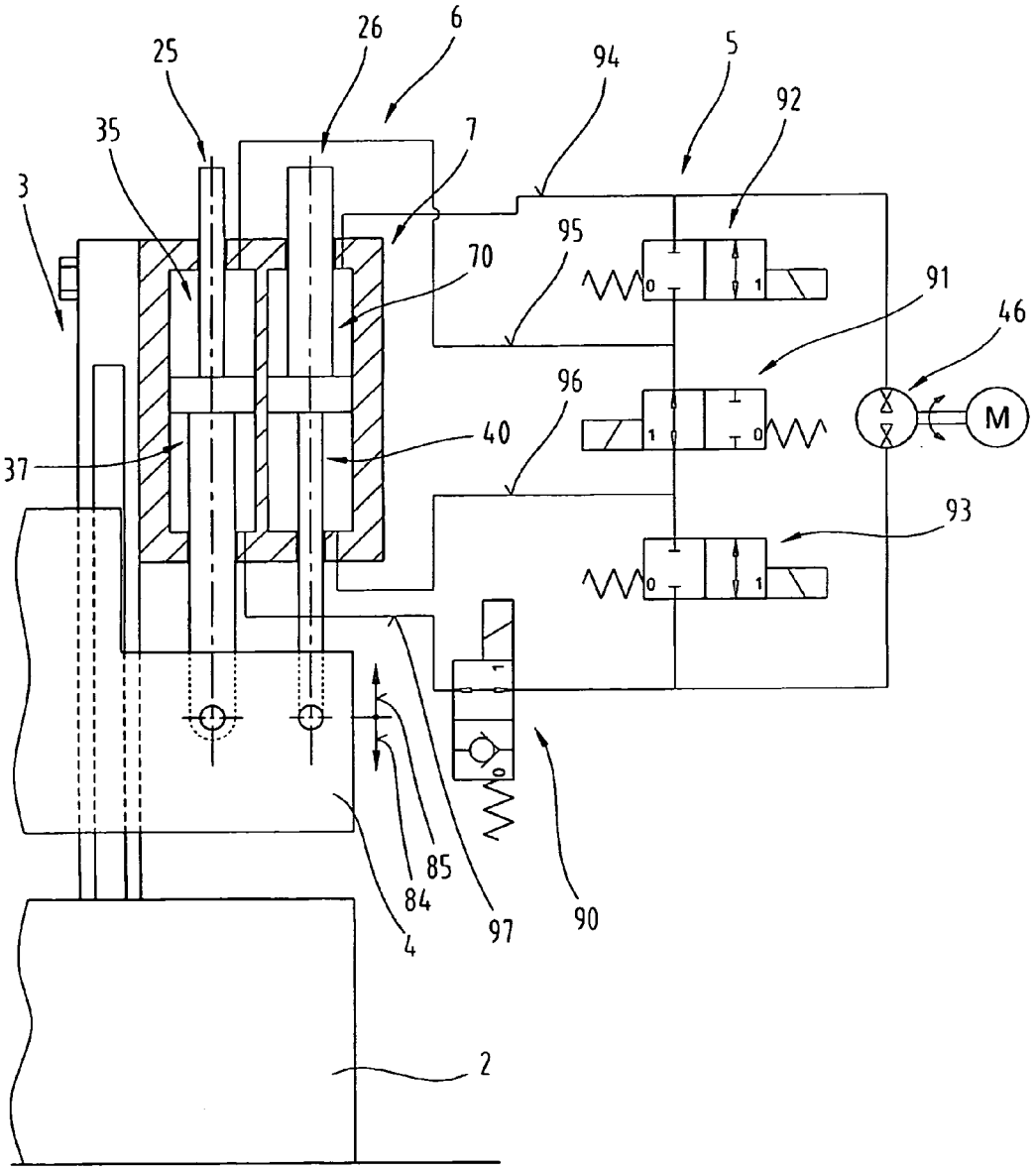
FIG. 7 shows the drive device with the tandem cylinder and a hydraulic system in a second switch mode.
Figure 8:
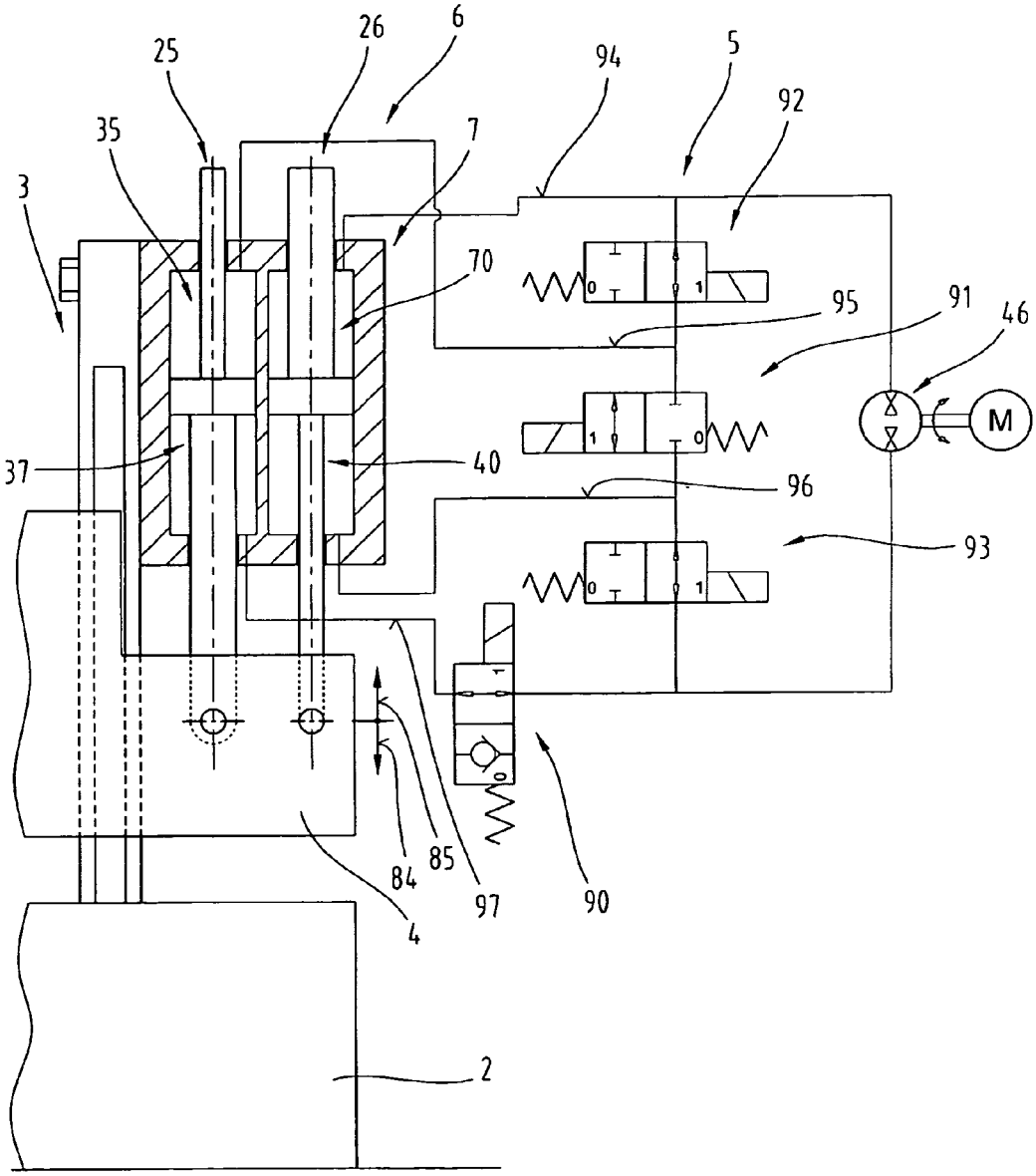
FIG. 8 shows the drive device with the tandem cylinder and a hydraulic system in a third switch mode.

FIGS. 6 to 8 illustrate another embodiment of the closed hydraulic system 5 of the beam adjusting device 6 with the hydraulic pump 46 and valves 90, 91, 92, 93, based on the example of activating the linear actuator 7 of a drive shaft of the bending press 3.

FIGS. 6 to 8 illustrate the essential operating modes for displacing the press beam 4—indicated by arrows 84, 85—and a non-operating position corresponding to switch positions of the valves 90, 91, 92, 93 as well as the disposition of lines 94, 95, 96, 97 to the pressure chambers 35, 37 of piston arrangement 25 and to the pressure chambers 40, 70 of piston arrangement 26 of the linear actuator 7. The switch mode illustrated in FIG. 6 is the operating mode "non-operating position", in FIG. 7 the operating mode "fast-traverse movement" and in FIG. 8 the operating mode "pressing operation movement".

For the sake of completeness, it should be pointed out that there are yet other, partially simplified but also extended possibilities for the design of the hydraulic system which will affect the dimensioning of the valves and switching performance between the operating modes and safety criteria in different ways.

The embodiments illustrated as examples represent possible variants of the drive device 1, and it should be pointed out at this stage that the invention is not specifically limited to the variants specifically illustrated, and instead the individual variants may be used in different combinations with one another and these possible variations lie within the reach of the person skilled in this technical field given the disclosed technical teaching. Accordingly, all conceivable variants which can be obtained by combining individual details of the variants described and illustrated are possible and fall within the scope of the invention.

For the sake of good order, finally, it should be pointed out that, in order to provide a clearer understanding of the structure of the part-feeding system, it and its constituent parts are illustrated to a certain extent out of scale and/or on an enlarged scale and/or on a reduced scale.

The objective underlying the independent inventive solutions may be found in the description.

Above all, the individual embodiments of the subject matter illustrated in FIGS. 1; 2; 3; 4; 5; 6, 7, 8 constitute independent solutions proposed by the invention in their own right. The objectives and associated solutions proposed by the invention may be found in the detailed descriptions of these drawings.

| List of reference numbers | |
|---|---|
| 1 | Drive device |
| 2 | Press beam |
| 3 | Bending press |
| 4 | Press beam |
| 5 | Hydraulic system |
| 6 | Beam adjusting device |
| 7 | Linear actuator |
| 8 | Control and regulating system |
| 9 | Control line |
| 10 | Press frame |
| 11 | Side panel |
| 12 | Cross member |
| 13 | Floor surface |
| 14 | Guide arrangement |
| 15 | Double arrow |
| 16 | Support surface |
| 17 | |
| 18 | Bending tool |
| 19 | |
| 20 | Workpiece |
| 21 | Die set |
| 22 | Actuator housing |
| 23 | booster cylinder |
| 24 | Actuator means |
| 25 | Piston arrangement |
| 26 | Piston arrangement |
| 27 | Piston |
| 28 | Piston |
| 29 | End region |
| 30 | Bearing arrangement |
| 31 | Piston rod |
| 32 | Piston rod |
| 33 | Mid-axis |
| 34 | Cylinder chamber |
| 35 | Pressure chamber |
| 36 | Piston working surface |
| 37 | Pressure chamber |
| 38 | Piston working surface |
| 39 | Cylinder chamber |
| 40 | Pressure chamber |
| 41 | Piston working surface |
| 42 | Internal diameter |
| 43 | Internal diameter |
| 44 | Arrow |

-continued

| List of reference numbers | |
|---|---|
| 45 | Arrow |
| 46 | Hydraulic pump |
| 47 | Drive motor |
| 48 | Control valve |
| 49 | |
| 50 | |
| 51 | Line |
| 52 | Line |
| 53 | Line |
| 54 | Line |
| 55 | Control valve |
| 56 | Control valve |
| 57 | Control valve |
| 58 | Ring line |
| 59 | Ring line; 59.1Connecting line |
| 60 | Storage |
| 61 | Check valve |
| 62 | Check valve |
| 63 | Line |
| 64 | Pump line |
| 65 | Tandem cylinder |
| 66 | Cylinder housing |
| 67 | Support arm |
| 68 | |
| 69 | |
| 70 | Pressure chamber |
| 71 | End wall |
| 72 | End wall |
| 73 | Piston rod |
| 74 | Piston rod |
| 75 | End region |
| 76 | End region |
| 77 | Internal diameter |
| 78 | Rod region |
| 79 | Diameter |
| 80 | Rod region |
| 81 | Diameter |
| 82 | Piston working surface |
| 83 | Piston working surface |
| 84 | |
| 85 | |
| 86 | |
| 87 | |
| 88 | |
| 89 | |
| 90 | Valve |
| 91 | Valve |
| 92 | Valve |
| 93 | Valve |
| 94 | Line |
| 95 | Line |
| 96 | Line |
| 97 | Line |

The invention claimed is:

1. A drive device for a bending press with a press frame having a stationary press beam and a press beam which can be displaced relative to the stationary press beam via a beam adjusting device formed by a closed hydraulic system, the closed hydraulic system comprising:

a hydraulic pump with a controllable drive motor, at least one control valve and at least one hydraulic linear actuator, the linear actuator comprising:

a first piston arrangement having a first piston which divides a cylinder chamber into a first pressure chamber and a second pressure chamber, wherein a piston working surface of the first piston bounds the first pressure chamber, and, in another cylinder chamber, a second piston arrangement with a second piston and at least one other pressure chamber, wherein a piston working surface of the second piston bounds the other pressure chamber, wherein the piston working surface of the second piston in the other pressure chamber is oriented in opposite direction to the piston working surface of the first piston in the first pressure chamber, wherein the first piston arrangement and the second piston arrangement are connected to the displaceable press beam with piston rods and are therefore rigidly coupled with one another, wherein the cylinder chambers are disposed with mid-axes extending parallel with one another in an actuator housing provided in the form of a tandem cylinder, and wherein the first pressure chamber of the first cylinder chamber is connected to the other pressure chamber in the parallel other cylinder chamber via the control valve.

2. The drive device according to claim 1, wherein the cylinder chambers form four separate, pressure-tight pressure chambers due to the pistons of the piston arrangements.

3. The drive device according to claim 2, wherein the piston arrangements forming the four pressure chambers have continuous piston rods which are connected to the displaceable press beam.

4. The drive device according to claim 3, wherein the piston rods respectively have two rod regions of different diameters from one another separated by pistons.

5. The drive device according to claim 3, wherein the piston arrangements with the rod regions of different diameters are disposed in a complementary layout in the cylinder chambers.

6. The drive device according to claim 1, wherein piston working surfaces of the piston arrangements co-operating with the pressure chambers have different surface dimensions.

7. The drive device according to claim 6, wherein a first piston working surface of the first piston approximately corresponds to a surface total of a second piston working surface of the first piston plus a third piston working surface of the second piston.

8. The drive device according to claim 6, wherein a surface total of respectively two piston working surfaces of the first and second pistons in a first hydraulic working direction corresponds to a surface total of respectively two other piston working surfaces of the first and second pistons in a second hydraulic working direction opposite to the first hydraulic working direction.

9. The drive device according to claim 1, wherein the actuator housing is of a one-piece design.

10. The drive device according to claim 1, wherein the actuator housing is rigidly connected to the press frame.

11. The drive device according to claim 1, wherein the piston rods are connected to the displaceable press beam in a driving relationship via bearing arrangements.

12. The drive device according to claim 1, wherein the hydraulic pump is provided in the form of a hydraulic four-quadrant machine.

13. The drive device according to claim 12, wherein a drive motor of the hydraulic pump is provided in the form of an electric motor, the rotation speed and direction of rotation of which can be varied, for example.

14. The drive device according to claim 1, wherein the hydraulic system has a control valve in the form of an emergency stop retaining valve and at least two control valves for activating the pressure chambers.

15. The drive device according to claim 14, wherein the control valve incorporating the emergency stop function is disposed in a connecting line of the pressure chamber of piston arrangement to the ring line.

16. The drive device according to claim 15, wherein the control valves are provided in the form of switchable, spring-resettable multi-way valves.

17. The drive device according to claim 1, wherein a flow connection is established between a storage and pump lines via connecting lines.

18. The drive device according to claim 17, wherein releasable check valves are disposed in the connecting lines.

19. The drive device according to claim 18, wherein the check valves are of a hydraulically releasable design.

20. The drive device according to claim 18, wherein the check valves are configured so as to be electrically releasable.

21. The drive device according to claim 1, wherein the internal diameters of the cylinder chambers are of identical dimensions.

22. The drive device according to claim 1, wherein the internal diameters of the cylinder chambers are of different dimensions.

* * * * *